US006543421B2

(12) United States Patent
Lorraine et al.

(10) Patent No.: US 6,543,421 B2
(45) Date of Patent: Apr. 8, 2003

(54) FUEL INJECTOR ASSEMBLY FOR MOUNTING A FUEL INJECTOR TO A FUEL RAIL AND PERMITTING ALIGNMENT OF THE FUEL INJECTOR

(75) Inventors: Jack R. Lorraine, Newport News, VA (US); Roberto Ricci, Leghorn (IT)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/813,355

(22) Filed: Mar. 21, 2001

(65) Prior Publication Data

US 2001/0037796 A1 Nov. 8, 2001

Related U.S. Application Data

(60) Provisional application No. 60/190,953, filed on Mar. 21, 2000.

(51) Int. Cl.[7] ..... F02M 61/14
(52) U.S. Cl. ..... 123/470
(58) Field of Search ..... 123/456, 468, 123/470; 239/600

(56) References Cited

U.S. PATENT DOCUMENTS

| | | | | |
|---|---|---|---|---|
| 4,143,625 A | | 3/1979 | Kulke | 123/470 |
| 4,240,385 A | | 12/1980 | Kulke | 123/470 |
| 4,485,790 A | | 12/1984 | Nishimura et al. | 123/468 |
| 4,693,223 A | | 9/1987 | Eshleman et al. | 123/468 |
| 4,823,754 A | | 4/1989 | Minamoto et al. | 123/470 |
| 4,893,601 A | | 1/1990 | Sugao | 123/468 |
| 5,765,534 A | | 6/1998 | Brown et al. | 123/470 |
| 5,775,302 A | | 7/1998 | Guido et al. | 123/468 |
| 5,893,351 A | * | 4/1999 | Akutagawa et al. | 123/470 |
| 5,943,995 A | | 8/1999 | Niwa et al. | 123/470 |
| 6,019,089 A | * | 2/2000 | Taylor et al. | 123/470 |
| 6,431,151 B1 | | 8/2002 | Gmelin | 123/470 |

FOREIGN PATENT DOCUMENTS

| | | | |
|---|---|---|---|
| DE | 196 06 946 A1 | 9/1997 | F02M/55/02 |
| DE | 197 35 665 A1 | 1/1999 | F02M/61/14 |

* cited by examiner

*Primary Examiner*—Tony M. Argenbright

(57) ABSTRACT

A fuel injector assembly for mounting a fuel injector to a fuel rail and permitting alignment of the fuel injector with an engine head. The assembly includes a cup having an upper portion and a lower portion, the upper portion being connected to a fuel rail, the lower portion including an interior, an exterior, and a lower surface. The fuel injector has an inlet, an outlet, and a fuel passageway extending from the inlet to the outlet, the inlet being disposed within the interior of the cup. A collar can be disposed proximate the lower surface of the cup, the collar cincturing the inlet of the fuel injector. A ring cinctures the inlet of the fuel injector. A fastener is secured to the exterior of the cup such that the ring establishes an interference fit between the collar and the inlet of the fuel injector.

17 Claims, 3 Drawing Sheets

FUEL INJECTOR ASSEMBLY FOR MOUNTING A FUEL INJECTOR TO A FUEL RAIL AND PERMITTING ALIGNMENT OF THE FUEL INJECTOR

CROSS-REFERENCE TO RELATED APPLICATIONS

This application claims priority to prior U.S. Provisional Application No. 60/190,953, filed on Mar. 21, 2000, the disclosure of which is incorporated by reference herein in its entirety.

FIELD OF INVENTION

This invention relates to fuel injectors in general, and more specifically to a fuel injector assembly for mounting a fuel injector to a fuel rail and permitting alignment of the fuel injector with an engine head. The invention also includes a locking mechanism to secure a fuel injector to a fuel rail permitting alignment of the fuel injector, as well as a method of securing a fuel injector to a fuel rail and a method of aligning a fuel injector connected to fuel rail with an engine head.

BACKGROUND OF THE INVENTION

It is believed to be known to use an engine head to locate a fuel injector for connection with a fuel rail in a conventional attachment system. It is believed that in the conventional system, the engine head includes a fuel injector mounting hole having a locating shoulder. It is believed that an outlet of the fuel injector having a combustion seal is disposed within the fuel injector mounting hole, such that a portion of the fuel injector contacts the shoulder of the engine head, and the combustion seal forms a fluid impermeable barrier with the fuel injector mounting hole. By this arrangement, it is believed that the fuel injector is axially located by the engine head. Typically, the fuel injector mounting hole in the engine head is elongated to more easily position the fuel injector. However, it is believed that the conventional system results in the disadvantage that the tip of the outlet can become caught on the shoulder in the engine head during installation of the fuel injector, possibly resulting in damage to the injector.

It is believed to be known to include a fuel seal on an inlet of the fuel injector for connection with the fuel rail. It is believed that after a typical fuel injector is installed in the engine head, a spring clip is used to secure a retaining feature of the fuel injector to the fuel rail. It is believed that the spring clip must be carefully aligned such that the fuel rail is precisely located and oriented relative to the fuel injector to avoid damaging the fuel and combustion seals of the fuel injector.

During operation of the system in an internal combustion engine, it is believed that carbon builds up on the tip of the injector. It is believed that the carbon build-up within the elongated flow hole and the shoulder of the fuel injector can cause the injector to become trapped within the flow hole. It is further believed that this can damage the fuel injector during attempted removal of the injector from the engine head, and can result in damage to the fuel injector during attempted removal of the injector from the engine head, and can damage the injector, the fuel rail, or other components of the system during the opening and closing of the fuel injector.

SUMMARY OF THE INVENTION

The invention provides a fuel injector assembly for mounting a fuel injector to a fuel rail. The assembly includes a cup having an upper portion and a lower portion, the upper portion being connected to a fuel rail, the lower portion including an interior, an exterior, and a lower surface. The fuel injector has an inlet, an outlet, and a fuel passageway extending from the inlet to the outlet, the inlet being disposed within the interior of the cup. A collar and a ring can cincture the inlet of the fuel injector. A fastener is secured to the exterior of the cup such that the ring establishes an interference fit between the collar and the inlet of the fuel injector.

In a preferred embodiment, a wrap cinctures the exterior of the cup and the fastener. The wrap can be heat shrink tubing and/or formed by heating and shrinking material to secure the cup and the fastener.

The invention also provides a method of aligning a fuel injector connected to a fuel rail with an engine head, the fuel injector having an inlet, an inlet seal cincturing the inlet, an outlet, an outlet seal cincturing the outlet, and a fuel passageway extending from the inlet to the outlet. The inlet seal is disposed in an interior of the fuel rail. The fuel injector is pivoted about the inlet seal such that the outlet of the fuel injector is aligned with an interior an the engine head. The outlet seal is disposed in the interior of the engine head.

The invention further provides a method of attaching a fuel injector to a fuel rail, the fuel injector having an inlet, an inlet seal cincturing the inlet, an outlet, an outlet seal cincturing the outlet, and a fuel passageway extending from the inlet to the outlet. The inlet seal is disposed in an interior of the fuel rail. A collar cinctures the inlet of the fuel injector with a collar. A fastener is connected to an exterior of the fuel rail such that the collar forms an interference fit with the inlet of the fuel injector.

BRIEF DESCRIPTION OF THE DRAWINGS

The accompanying drawings, which are incorporated herein and constitute part of this specification, illustrate preferred embodiments of the invention, and, together with the general description given above and the detailed description given below, serve to explain features of the invention.

DETAILED DESCRIPTION OF THE PREFERRED EMBODIMENT(S)

Figure 1:
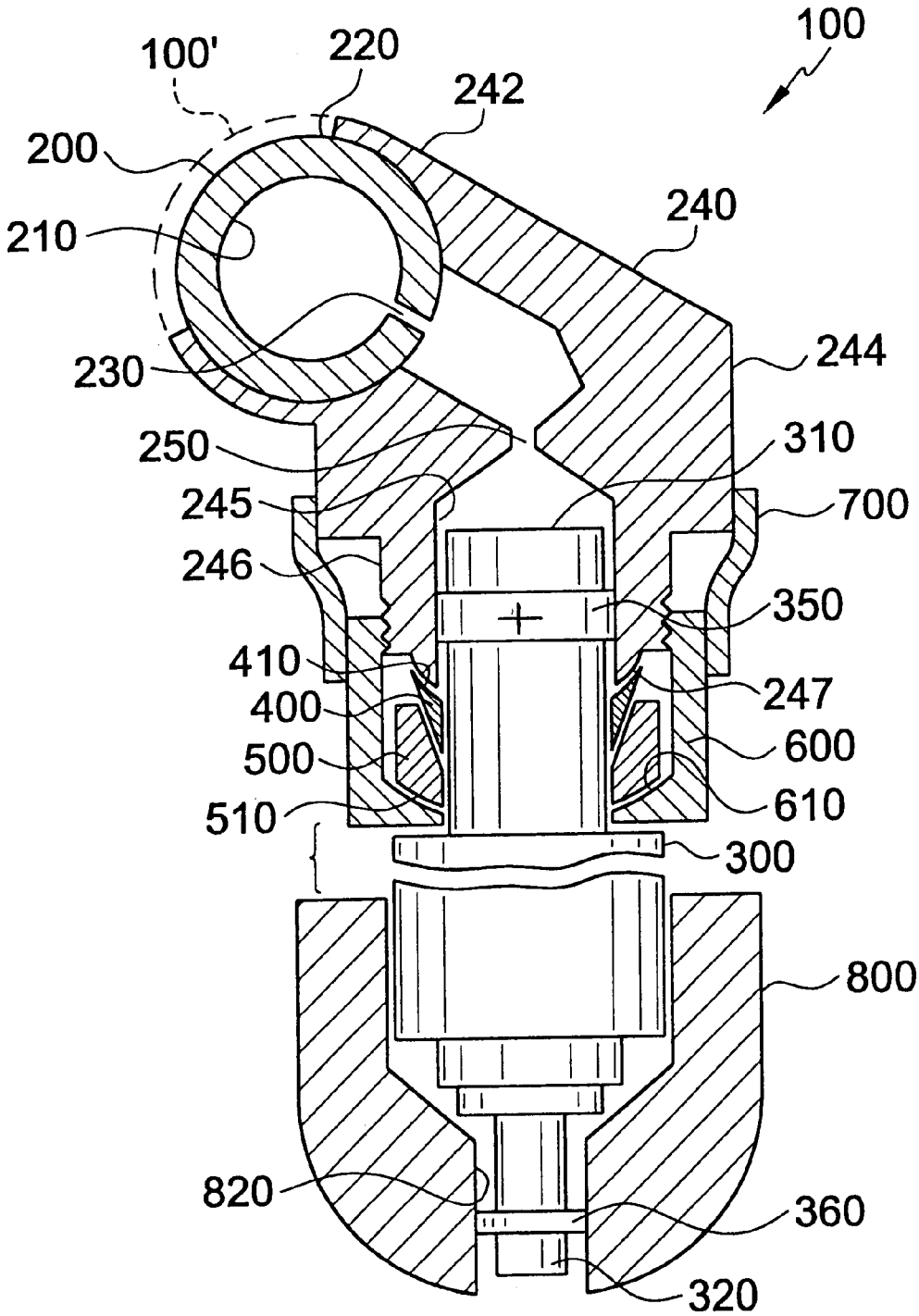
FIG. 1 is a cross-sectional view of a fuel injector assembly of a preferred embodiment.

FIG. 1 shows an example of a preferred embodiment of the fuel injector assembly 100. A preferred embodiment of the fuel injector assembly 100 can include a fuel rail 200, a fuel injector 300, a collar 400, a ring 500, a fastener 600, a wrap 700, and an engine head 800. The assembly 100 permits the fuel injector 300 to be connected to the fuel rail 200 and aligned with the engine head 800.

The fuel rail 200 includes an interior 210, an exterior 220, and an orifice 230 disposed between the interior 210 and the exterior 220 of the fuel rail 200. The interior 210 is designed to deliver fuel to the fuel injector 300. Fuel flowing through the fuel rail 200 is delivered from the interior 210 through the orifice 230 to a cup 240. The fuel rail 200 is connected to a mounting surface of the engine head 800.

The cup 240 includes an upper portion 242 and a lower portion 244. The upper portion 242 is connected to the exterior 220 of the fuel rail 200. The lower portion 244 includes an interior 245, an exterior 246, and a lower surface 247. The cup 240 can be manufactured using a variety of methods, including material removal processes, metal injection molding, and the like. Preferably, the upper portion 242 can be connected to the fuel 200 by furnace brazing. The cup 240 can have large cavities in both the upper and lower portions 242 and 244 and a relatively small orifice 250 therebetween. The orifice 250 dampens the pressure drop within the cup 240 when the fuel injector 300 opens during operation.

The fuel injector 300 includes an inlet 310, and outlet 320, and a fuel passageway (not shown) extending from the inlet 310 to the outlet 320. The inlet 310 is disposed within the interior 245 of the cup 240. The fuel injector 300 can also include an inlet seal 350 cincturing the inlet 310, and can include an outlet seal 360 cincturing the outlet 320. The inlet seal 350 can be disposed within the interior 245 of the cup 240 to form a fluid impermeable seal. A lead-in can be provided at the interface between the interior 245 and the lower surface 247 so as to facilitate receiving the inlet seal 350. By this arrangement, the cup 240 and the fuel rail 200 establish an axial position for the fuel injector 300, and permit relative angular movement therebetween. The relative angular movement may be between 0.5 degrees and 1 degree. The inlet seal 350 permits positioning of the fuel injector 300 relative to the fuel rail 200, since the fuel injector 300 can be pivoted about the inlet seal 350 within the cup 240. Because the fuel injector 300 is secured to the fuel rail 200 through the use of the cup 240, it is unnecessary to provide an attachment clip on the fuel injector 300, on what is believed to be a conventional manner of securing a fuel injector to a fuel rail.

The collar 400 is disposed proximate the lower surface 247 of the cup 240. The collar 400 cinctures the inlet 310 of the fuel injector 300. The collar 400 can be sized and shaped such that it can be deformed to capture the inlet 310 of the fuel injector 300. As shown in the drawing, the collar 400 can include a wedge shape to capture the fuel injector 300.

The ring 500 is disposed between the collar 400 and the fastener 600. The ring 500 cinctures the inlet 310 of the fuel injector 300. The ring 500 can be sized and shaped such that when the ring 500 is brought into contact with the collar 400, the ring 500 deforms the collar 400 to secure the fuel injector 300. As shown in the drawing, the ring 500 can be shaped such that a taper of the ring deforms the collar 400 to secure the fuel injector 300. The ring 500 can also include a bottom surface 510 disposed proximate the fastener 600.

The fastener 600 is secured to the exterior 246 of the cup 240. The fastener 600 is sized, shaped, and oriented such that the ring 500 established an interference fit between the collar 400 and the inlet 310 of the fuel injector 300. By this arrangement, when the fastener 600 is operated with respect to the cup 240, e.g., by relative rotation of respective threaded portions, the ring 500 is displaced relative to the collar 400 such that the collar 400 is compressively secured with respect to the fuel injector inlet 310. Consequently, a relatively low axial force can obtain a relatively high radial locking force. The fastener 600 can include a spherical surface 610 confronting a corresponding spherical surface 510 on the ring 500. The center of these spherical portions 510,610 can be coincident with the center of the inlet seal 350. Similarly, the ring 400 can have a spherical surface 410 confronting a corresponding spherical lower surface 247 on the cup 240. The centers of these spherical portions 410,247 can also be coincident with the center of the inlet seal 350. By this arrangement, the collar 400 and ring 500 arrangement can be located between the cup 240 and the fastener 600 with a relatively small or minimum radial force.

It is also possible to reverse the positions of the ring 400 and collar 500 with respect to the fastener 600 and the lower surface 247. Thus, a spherical surface of the ring 400 would confront the spherical surface 610 of the fastener 600, and a spherical surface of the collar 500 would confront the lower surface 247 of the cup 240.

The fuel injector assembly can also include a wrap 700 cincturing the exterior 246 of the cup 240 and the fastener 600. In a preferred embodiment, the wrap 700 can be manufactured of heat shrink tubing, and/or formed by a process that includes heating and shrinking material to secure the cup 240 and the fastener 600. The wrap 700 can also be a metal tube that is deformed to secure the cup 240 and the fastener 600.

The engine head 800 includes an interior 820, the outlet 320 of the fuel injector 300 disposed within the interior 820. The outlet seal 360 located on the outlet 320 of the fuel injector 300 can be disposed in the interior 820 of the engine head 800 to form a fluid impermeable seal and to locate the outlet of the fuel injector. By this arrangement, after the fuel injector 300 is secured to the fuel rail 200, the fuel injector 300 is aligned with the interior 820 of the engine head 800. The interior 820 of the engine head 800 does not require a shoulder, as required in a conventional fuel injector mounting assembly. Further, since the interior 820 of the engine head 800 is not needed to align the axial position of the fuel injector 300, the interior 820 does not need to be as long as an interior of a conventional engine head.

Figure 2:
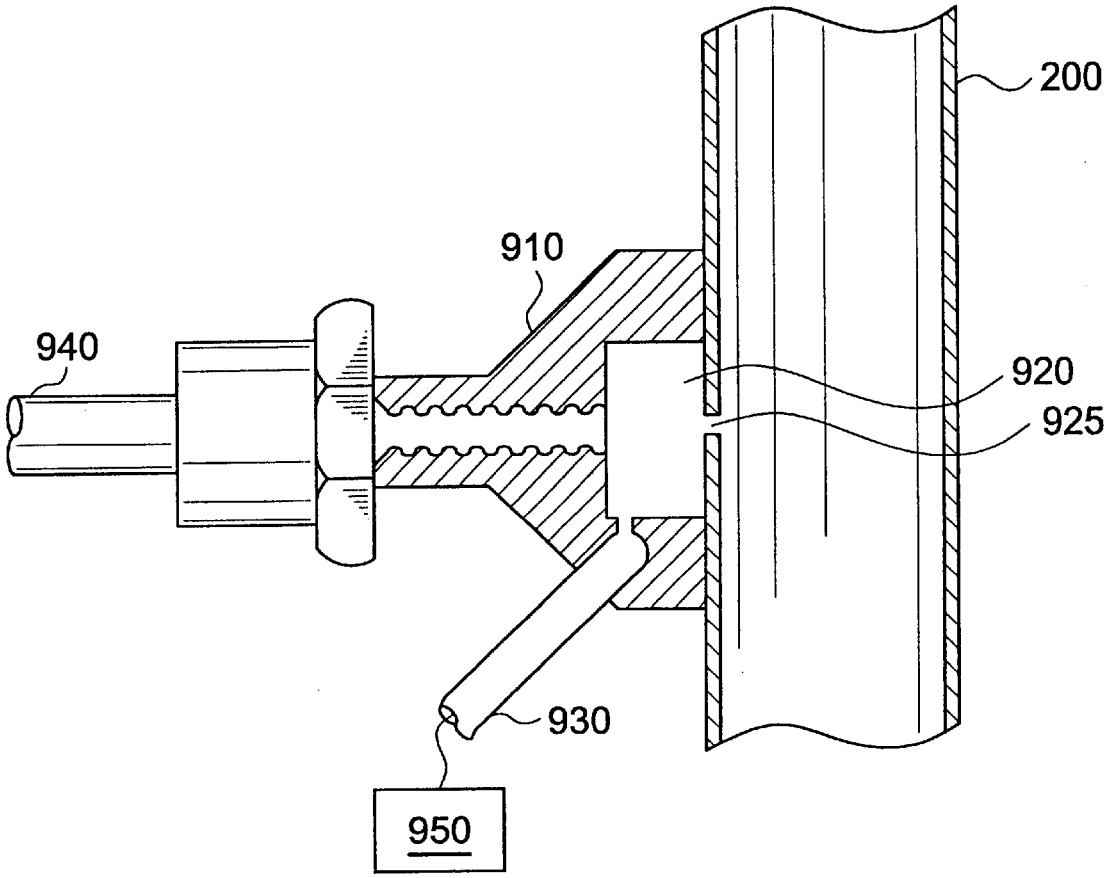
FIG. 2 is an elevation view of a pressure sensor boss of the preferred embodiment.

FIG. 2 shows a pressure sensor boss 910 connected to the fuel rail 200. The sensor boss 910 includes a cavity 920, an orifice 925 providing fluid communication between the fuel rail 200 and the cavity 920, and a flow tube 930 providing fluid communication between the cavity 920 and a high pressure pump 950. The flow tube 930 is disposed such that the incoming fuel from the high pressure pump 950 swirls about the cavity 920. A pressure sensor 940 is connected to the pressure sensor boss 910. The pressure sensor boss 910 can be furnace brazed to the fuel rail 200.

Figure 3:
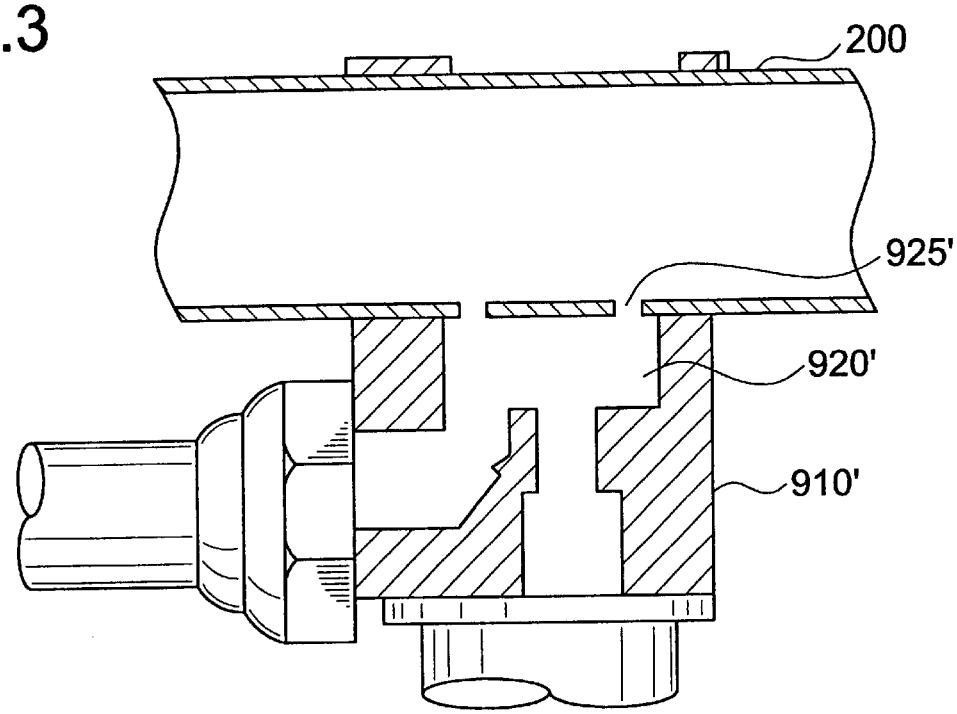
FIG. 3 is an elevation view of another embodiment of the pressure sensor boss.
Figure 4:
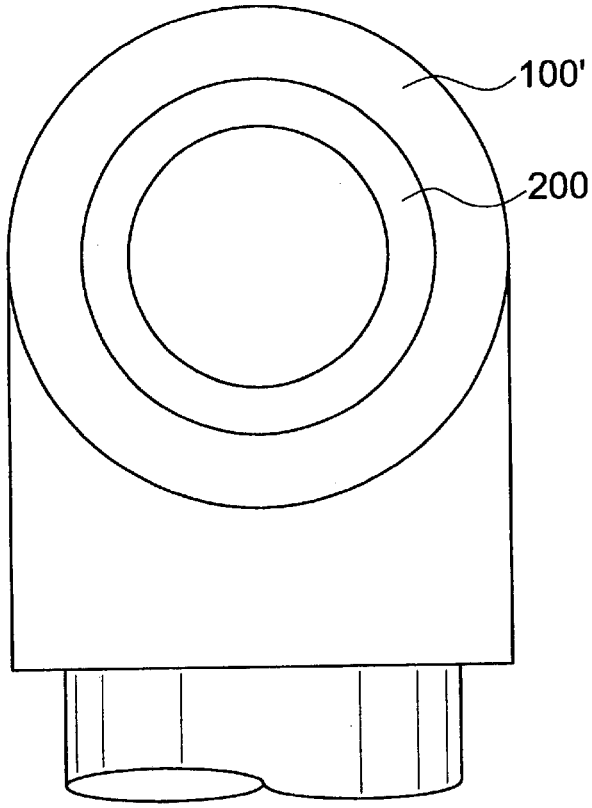
FIG. 4 is a side view of the pressure sensor boss of FIG. 3.

FIGS. 3 and 4 show an alternate fuel injector assembly 100' featuring an alternative pressure sensor boss 910' connected to the fuel rail 200. The pressure sensor boss 910' circumscribes the fuel rail 200, whereas the pressure sensor boss 910 only partially circumscribes the fuel rail 200. Although not shown, the pressure sensor boss 910' may provide an end closure for at a terminus of the fuel rail 200. The sensor boss 910' includes a cavity 920' and an orifice 925' that provides fluid communication between the fuel rail 200 and the cavity 920'.

The preferred embodiment of the disclosed fuel injector assembly provides a method of aligning a fuel injector connected to a fuel rail with an engine head, the fuel injector having an inlet, an inlet seal cincturing the inlet, an outlet, an outlet seal cincturing the outlet, and a fuel passageway extending from the inlet to the outlet. The inlet seal is disposed in an interior of the fuel rail. The fuel rail can include a cup having an upper portion and a lower portion, the upper portion connected to an exterior of the fuel rail, the lower portion including an interior in which the inlet seal of the fuel injector is disposed. The fuel injector is pivoted about the inlet seal such that the outlet of the fuel injector is aligned with an interior an the engine head. A fastener can be secured to an exterior of the lower portion of the cup, such that a ring establishes an interference fit between a collar and the inlet of the fuel injector, the ring cincturing the inlet of the fuel injector, and the collar proximate a lower surface of the lower portion of the cup and cincturing the inlet of the fuel injector. The outlet seal is disposed in the interior of the engine head. By this method, a fuel injector (e.g., 300) can be connected to a fuel rail (e.g., 200) and aligned with and installed in an engine head (e.g., 800).

The preferred embodiment of the disclosed invention also provides a method of attaching a fuel injector to a fuel rail, the fuel injector having an inlet, an inlet seal cincturing the inlet, an outlet, an outlet seal cincturing the outlet, and a fuel passageway extending from the inlet to the outlet. The inlet seal is disposed in an interior of the fuel rail. The fuel rail can include a cup having an upper portion and a lower portion, the upper portion connected to an exterior of the fuel rail, the lower portion including an interior in which the inlet seal of the fuel injector is disposed. A ring can cincture the inlet of the fuel injector. A collar cinctures the inlet of the fuel injector, and can be disposed proximate a lower surface of the lower portion of the cup. A fastener is connected to an exterior of the fuel rail such that the collar forms an interference fit with the inlet of the fuel injector. The fastener can be secured such that the ring establishes the interference fit between the collar and the fuel injector.

While the invention has been disclosed with reference to certain preferred embodiments, numerous modifications, alterations and changes to the described embodiments are possible without departing from the sphere and scope of the invention, as defined in the appended claims and equivalents thereof. Accordingly, it is intended that the invention not be limited to the described embodiments, but that it have the full scope defined by the language of the following claims.

What we claim is:

1. A fuel injector assembly, comprising:

a fuel rail;

a cup having an upper portion and a lower portion, the upper portion connected to the fuel rail, the lower portion including an interior, an exterior, and a lower surface;

a fuel injector having an inlet, an outlet, and a fuel passageway extending from the inlet to the outlet, the inlet disposed within the interior of the cup;

a collar cincturing the inlet of the fuel injector;

a ring cincturing the inlet of the fuel injector; and a fastener secured to the exterior of the cup such that the ring establishes an interference fit between the collar and the inlet of the fuel injector.

2. The fuel injector assembly according to claim 1, further comprising a wrap cincturing the exterior of the cup and the fastener.

3. The fuel injector assembly according to claim 2, wherein the wrap comprises heat shrink tubing.

4. The fuel injector assembly according to claim 2, wherein the wrap is formed by heating and shrinking material to secure the cup and the fastener.

5. The fuel injector assembly according to claim 1, wherein the connection between the upper portion of the cup and the fuel rail comprises a furnace braze.

6. The fuel injector assembly according to claim 1, further comprising an engine head including an interior, the outlet of the fuel injector disposed within the interior of the engine head.

7. The fuel injector assembly according to claim 6, wherein the fuel injector includes an inlet seal cincturing the inlet, and an outlet seal cincturing the outlet, the inlet seal being disposed within the interior of the cup to form a fluid impermeable seal and to permit positioning of the fuel injector relative to the fuel rail, and the outlet seal being disposed in the interior of the engine head to form a fluid impermeable seal and to locate the outlet of the fuel injector.

8. The fuel injector assembly according to claim 1, wherein the collar is proximate the lower surface of the cup.

9. The fuel injector assembly according to claim 1, herein the ring is proximate the lower surface of the cup.

10. A fuel injector assembly, comprising:

a fuel rail;

a cup having an upper portion and a lower portion, the upper portion connected to the fuel rail, the lower portion including an interior, an exterior, and a lower surface, the connection between the upper portion of the cup and the fuel rail including a furnace braze;

a fuel injector having an inlet, an outlet, and a fuel passageway extending from the inlet to the outlet, the inlet disposed within the interior of the cup;

a collar proximate the lower surface of the cup, the collar cincturing the inlet of the fuel injector;

a ring cincturing the inlet of the fuel injector;

a fastener secured to the exterior of the cup such that the ring establishes an interference fit between the collar and the inlet of the fuel injector;

a wrap cincturing the exterior of the cup and the fastener, the wrap formed by heating and shrinking material to secure cup and the fastener; and an engine head including an interior, the outlet of the fuel injector disposed within the interior of the engine head.

11. A method of aligning a fuel injector connected to a fuel rail with an engine head, the fuel injector having an inlet, an inlet seal cincturing the inlet, an outlet, an outlet seal cincturing the outlet, a collar cincturing the inlet, and a fuel passageway extending from the inlet to the outlet, comprising:

disposing the inlet seal in an interior of the fuel rail;

pivoting the fuel injector about the inlet seal such that the outlet of the fuel injector is aligned with an interior of the engine head;

disposing the outlet seal in the interior of the engine head; and forming an interference fit between the collar and the inlet of the fuel injector.

12. A method of attaching a fuel injector to a fuel rail, the fuel injector having an inlet, an inlet seal cincturing the inlet, an outlet, an outlet seal cincturing the outlet, and a fuel passageway extending from the inlet to the outlet, comprising:

disposing the inlet seal in an interior of the fuel rail;

cincturing the inlet of the fuel injector with a collar; and connecting a fastener to an exterior of the fuel rail such that the collar forms an interference fit with the inlet of the fuel injector.

13. The method according to claim 12, further comprising:

pivoting the fuel injector about the inlet seal so as to be aligned with an interior of an engine head.

14. The method according to claim 13, further comprising:

disposing the outlet seal in the interior of the engine head.

15. A locking mechanism to secure a fuel injector to a fuel rail, the fuel injector having an inlet disposed within the fuel rail, comprising:

a collar cincturing the inlet of the fuel injector and disposed proximate a bottom surface of the fuel rail;

a ring cincturing the inlet of the fuel injector; and a fastener secured to an exterior surface of the fuel rail such that the ring provides an interference fit between the collar and the inlet of the fuel injector.

16. The locking mechanism according to claim 15, further comprising a wrap cincturing the exterior of the fuel rail and the fastener.

17. The locking mechanism according to claim 16, wherein the wrap is formed by heating and shrinking material to secure the fuel rail and the fastener.

* * * * *